United States Patent [19]

Diaz-Kotti

[11] Patent Number: 4,830,915

[45] Date of Patent: May 16, 1989

[54] NON-WOVEN WET PRESS FELT FOR PAPERMAKING MACHINES

[75] Inventor: Michelle Diaz-Kotti, Johnston, S.C.

[73] Assignee: Asten Group, Inc., Charleston, S.C.

[21] Appl. No.: 94,666

[22] Filed: Sep. 9, 1987

[51] Int. Cl.[4] ..... B32B 5/16

[52] U.S. Cl. ..... 428/110; 28/107; 139/383 A; 156/148; 156/308.2; 162/358; 162/DIG. 1; 428/109; 428/113; 428/280; 428/282; 428/284; 428/287; 428/296; 428/300

[58] Field of Search ..... 428/109, 110, 113, 284, 428/287, 280, 282, 296, 300; 28/107; 156/148, 308.2; 162/DIG. 1, 358; 139/383 A

[56] References Cited

U.S. PATENT DOCUMENTS

| | | | |
|---|---|---|---|
| Re. 21,890 | 8/1941 | Walsh et al. | 28/4 |
| 2,581,790 | 1/1952 | Gates | 28/79 |
| 3,059,312 | 10/1962 | Jamieson | 28/79 |
| 3,086,276 | 4/1963 | Bartz et al. | 28/79 |
| 3,664,905 | 5/1972 | Schuster | 161/59 |
| 3,920,511 | 11/1975 | Grieves et al. | 162/348 |
| 3,928,699 | 12/1975 | Fekete | 428/212 |
| 4,356,225 | 10/1982 | Dufour | 128/234 |
| 4,357,386 | 11/1982 | Luciano et al. | 428/234 |
| 4,427,734 | 1/1984 | Johnson | 428/234 |
| 4,500,588 | 2/1985 | Lundstrom | 428/212 |
| 4,529,643 | 7/1985 | Lundstrom | 428/234 |
| 4,565,735 | 1/1986 | Murka et al. | 428/234 |

*Primary Examiner*—James J. Bell

*Attorney, Agent, or Firm*—Volpe and Koenig

[57] ABSTRACT

A papermaker's wet press felt constructed entirely from a plurality of layers of non-woven batt fibers which have layers of polymeric mesh interposed between and alternating with the batt layers. The mesh layers may be a thermoplastic material having a lower melt temperature than the batt fibers. The mesh layers and batt layers may be fixed by needling, sewing, heating or some combination thereof.

32 Claims, 1 Drawing Sheet

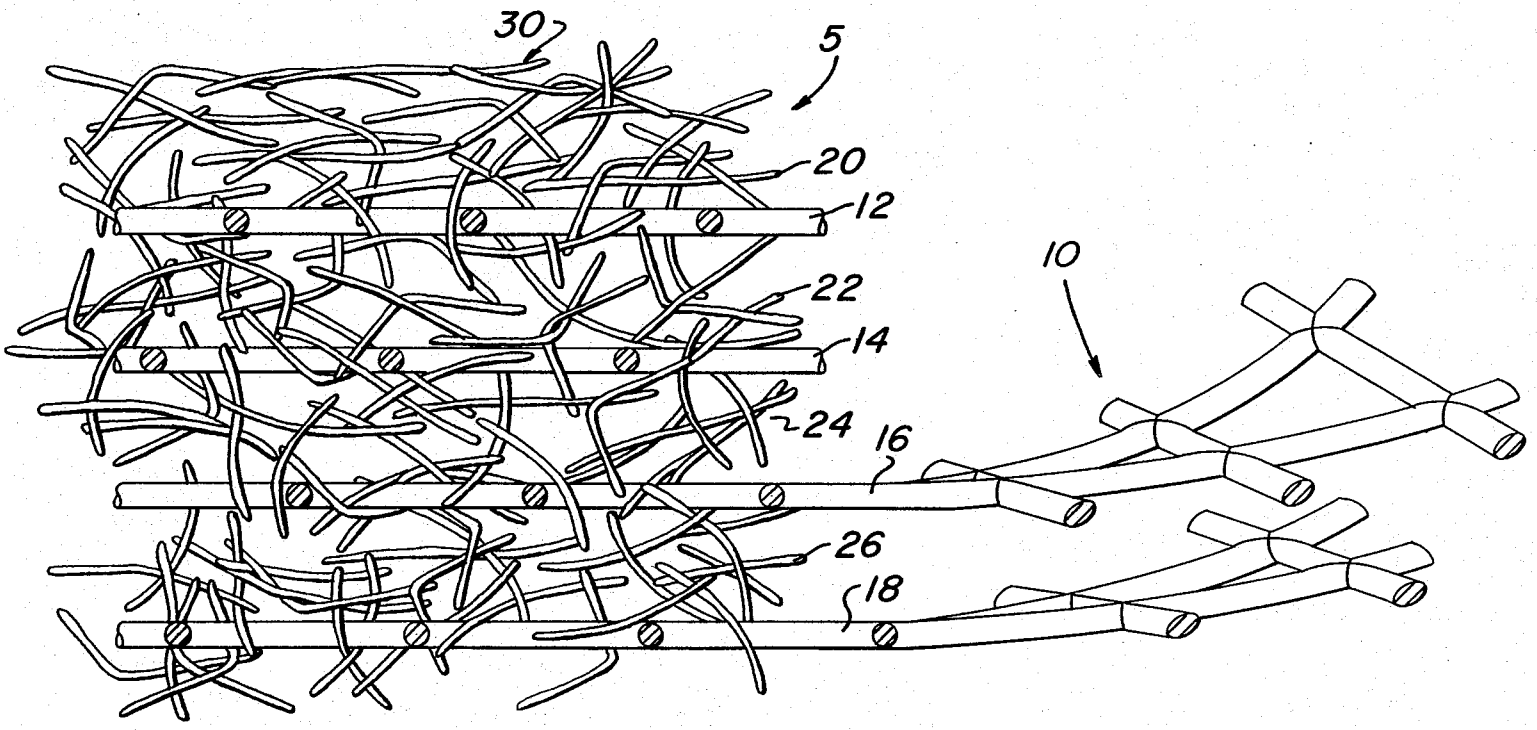
10
5
20
12
22
14
24
16
26
18
30

NON-WOVEN WET PRESS FELT FOR PAPERMAKING MACHINES

BACKGROUND OF THE INVENTION

The present invention relates to a felt for papermaking machines and more particularly to a non-woven felt for use in the wet press section of a papermaking machine.

The prior art includes a number of attempts to provide a construction particularly suitable for use in the wet press section of a papermaking machine. In the construction of a wet press felt, the desirability of maintaining a controlled void volume within the felt has been recognized. In use, loss of void volume due to compaction of wet press felts upon repeated passes through the nip of the wet press rollers is common. The compaction of the wet press felt shortens the useful life of the felt by limiting the drainage of water thrugh the felt. This also reduces the efficiency of the paperamaking machine.

Typical prior art wet press felts include a woven fabric base to which is needled a batt material. See for example the descriptions given in U.S. Pat. Nos. Re. 21,890; 2,581,790; 3,059,312; 3,086,276; 3,928,699; 4,356,225, 4,427,734; 4,529,643 and 4,565,735.

In U.S. Pat. No. 4,427,734, a wet pressed felt comprising a woven base, layers of mesh fabric and layers of non-woven batt material is disclosed. The layers of mesh fabric are interposed between layers of batt material. The layers of mesh fabric and batt material are needled to a base fabric of interwoven textile yarns.

U.S. Pat. No. 4,356,225 discloses a wet press felt which comprises a woven base with batts needled thereto in which a three ply weave pattern of the woven base results in an improved void volume and increased fabric stability.

The construction of a wet press felt which includes a woven base with batts needled thereto is a complicated and expensive process. Wet press felt constructions which do not employ a woven fabric base have been considered. U.S. Pat. No. 3,664,905 discloses a papermaker's felt which comprises alternating layers of oriented fibers of batt material which are interconnected by needling and a blown adhesive layer.

U.S. Pat. No. 3,920,511 discloses a non-woven papermaker's felt which comprises a plurality of layers of webs formed of fibers oriented substantially longitudinally consolidated into a homogeneous mass and a web of fibers is needled thereinto.

SUMMARY OF THE INVENTION

The present invention comprises a wet press felt for use on a papermaking machine which comprises alternating layers of batt material and polymeric mesh. The mesh layers are interposed between adjacent layers of batt material and the layers interconnected or united, as by needling. The wet press felt of the present invention is easily formed and does not include a woven base fabric. Orientation of mesh layers between adjacent layers of batt material and needling provides for an easily manufactured wet press felt which also resists compaction and exhibits a relatively stable void volume even after repeated passes through the nip of wet press rollers.

BRIEF DESCRIPTION OF THE DRAWINGS

FIG. 1 is an illustrative cross sectional view of a portion of a wet press felt according to the present invention, which further illustrates the partially separated mesh portion.

DESCRIPTION OF THE PREFERRED EMBODIMENT

With reference to FIG. 1, the wet press felt 5 of the present invention includes layers of a non-woven batt material 20, 22, 24 and 26. The non-woven batt material of layers 20, 22, 24 and 26 may be made up of conventional textile fibers. Representative textile fibers include the synthetic fibers of polyesters, polyolefins and polyamides. The fibers of layers 20, 22, 24 and 26 may be randomly aligned or may be oriented in the machine direction, cross machine direction or some variation thereof. If desired for ease of formation, each layer 20, 22, 24 and 26 may be individually pre-needled prior to being oriented as shown in the FIGURE. The batt material may include, interspersed therein, thermoplastic fibers as described herein below.

Interposed between the batt layers 20, 22, 24 and 26 are layers 12, 14, 16 and 18 of a polymeric mesh 10. The polymeric mesh 10 is preferably a non-woven netting in the form of a synthetic polymeric material such as polypropylene, polyamide, polyethylene or polyester. The melt point of the polymeric mesh 10 may be lower than the melt point of the batt material. The polymeric mesh 10 maybe formed in any suitable manner. For example, the polymeric mesh 10 may be formed by extruding, the preferred manner, by molding or by laying out monofilaments and heating to fuse the monofilaments at contact points. When the melt point of the polymeric mesh 10 is lower than the melt point of the batt material, the mesh melt point must be sufficiently high that the mesh is not substantially softened or weakened by the heats encountered in the wet press section of a papermaker's machine. To provide additional strength runner yarns (not shown) may be fixed to the bottom surface of the felt. Such runner yarns increase felt strength as well as provide additional void volume in a manner known to a person skilled in the art.

Interconnection of the batt layers 20, 22, 24 and 26 with the polymeric mesh 12, 14, 16 and 18 is preferably accomplished by needling. Needling is a well known technique for consolidating and stabilizing felt structures (see for example U.S. Pat. Nos. 3,086,276 and Re 21,890).

If desired, the batt material of outer layer 20 may comprise relatively fine, lower denier fibers than the interior layers 22, 24 and 26 in order to provide a smooth outer surface 30 and increased internal void volume for the felt 5. Additionally, the outer layer 20 of batt material may be relatively fine with one or more of with interior layers 22, 24 and 26 being of varying coarseness to provide a stratified mesh. Alternatively, a very fine mesh layer (not shown) may be oriented on batt layer 20, forming outer surface 30 of the felt. Likewise an optional bottom layer (not shown) which corresponds to layer 20 may be provided so that the exposed surfaces of the felt are similar in texture. The inverse, with courser exposed layers and finer interior layers may also be provided.

It should be understood that the representation of batt layers 20, 22, 24 and 26 in the figure are for illustration purposes only. In practice, the batt layers are much denser, that is have many more fibers more closely packed than is illustrated. For clarity in the FIGURE, representations of batt layers have been shown.

The polymeric mesh 10 is preferably a net like structure formed from synthetic, polymeric resins in a manner well known to a person of ordinary skill in the art. The mesh structure may be a series of open squares as shown, or may comprise a series of any other open geometric shape such as rectangles or other polygons. Preferably, the polymeric mesh layer 12 closest to outer surface 30 comprises a finer mesh count than the remaining layers 14, 16, and 18 in order to provide a graduated void volume for the wet press felt which increases in the direction away from the outer surface 30. For example, mesh layers 12, 14, 16 and 18 may comprise mesh materials having a strand count of 56, 28, 14 and 7 strands per inch respectively. Such a graduated mesh count provides a fabric having a substantially linear density gradient through the fabric.

The mesh layers 10 may be formed from a thermoplastic resin having a lower melt point than the batt material, whereby anchorage of the batt layers to the polymeric mesh may be enhanced by the heating of the felt after formation. Additional thermoplastic fibers, not shown, may be interspersed within the batt layers 20, 22, 24, and 26 to further enhance anchorage of the felt upon heating. Such additional thermoplastic fibers preferably have a melt temperature below that of the polymeric mesh 10 and the batt material. Anchorage of the batt layers may thereby be enhanced by heating. All of the fibers are preferably selected to have a melt temperature high enough that they are not effected by the normal temperatures encountered by a felt in the wet press section of a papermaker's machine. The anchorage between layers may also be enhanced by sewing in combination with needling.

The use of thermoplastic fibers interspersed within the batt layers 20, 22, 24 and 26 such that anchorage may be enhanced by heating is especially effective when fibers resistant to needling are employed. Such thermoplastic fibers unify the batt layers when heated to a temperature near the melt point of the thermoplastic fibers. Fibers such as carbon, graphite, aramids and ceramics which may make up part or all of the batt layers are resistant to needling. When such fibers are employed, either in the batt layers or as separate layers, the use of interspersed thermoplastic fibers for enhanced anchorage or adjacent layers is preferred.

The wet press felt of the present invention can be formed by unifying the mesh and batt layers in a variety of ways. For example, a layer of polymeric mesh and batt material may be sewn together in an initial forming step followed by needling and possibly additional layers of mesh and batt attached by needling. Alternatively, a polymeric mesh and batt layer may be pre-needled and then needled to additional mesh or mesh and batt layers. Alternatively, the batt material may be pre-needled into layers, the felt is then formed by alternating layers of polymeric mesh and pre-needled batts which are needled to anchor the layers. Through these methods, composites of varying thickness may be formed. The number of layers, and thus the thickness of the wet press felt can be varied to provide a wet press felt having desired properties of surface finish, void volume, aversion to rewetting and strength. To further enhance anchorage of adjacent layers, the above felt composites may be heated to a temperature above the softening point of the thermoplastic polymeric mesh but below the softening point of the batt material to provide additional interlayer anchoring. If the batt layers include thermoplastic fibers dispersed therein, the heating also improves interlayer anchoring. While heating to the mesh softening point can improve anchorage it also may effect the strength of the felt. Appropriate selection of materials, the felt layering and layer orientation can take into account the effects of heating on fabric strength.

The felt preferably has a strength sufficient to withstand operating tensions of 15 pounds per linear inch without stretching. This strength is provided in parts by the mesh layers and in part by the batt layers. A single mesh layer with 2 layers of batt material may be of sufficient strength. Typically, more than one and as many as about eight mesh layers may be employed. The desired number of mesh and batt layers is determined in part by the strength of the particular mesh and batt layer combination selected. For example, batt layer fibers oriented in the machine direction will increase the strength of the felt. Typical mesh sizes range from about 4 to 64, that is, there are sufficient strands to define about 4 to 64 openings per linear inch. The mesh layers preferably have calipers of from about 0.010 inches to 0.90 inches.

It should be understood that the foregoing description and drawings of the invention are not intended to be limiting, but are only exemplary of the inventive features which are defined in the claims.

What is claimed is:

1. An integral multilayer papermaker's wet press felt for use in a papermaking machine wherein each and every layer of said felt is comprised entirely of non-woven material; said layers comprising a plurality of non-woven polymeric netting layers which alternating with a plurality of layers of non-woven textile fiber batt layers which are united to said non-woven polymeric netting layers.

2. The papermaker's wet press felt of claim 1, wherein said textile fiber batt layers are united with said polymeric netting layers by needling.

3. The papaermaker's wet press felt of claim 1, wherein said textile fiber batt layers are united with said polymeric netting layers by sewing and needling.

4. The papermaker's wet process felt of claim 1, wherein said textile fiber batt layers have a higher melt temperature than said polymeric netting layers.

5. The papermaker's wet press felt of claim 4, wherein said polymeric netting layers comprise a thermoplastic material selected from the group consisting of polypropylene, polyethylene, polyamide, and polyester.

6. The papermaker's wet press felt of claim 4, wherein said non-woven textile fiber batt layers include thermoplastic fibers dispersed therein.

7. The papermaker's wet press felt of claim 1, wherein the mesh count of said polymeric netting layers varies from layer to layer.

8. The papermaker's wet press felt of claim 1, wherein the top and bottom surfaces of said felt are defined by said batt layers.

9. A multilayer papermaker's wet press felt for use in a papermaking machine wherein each and every layer of said felt comprises a non-woven material, said fabric comprising at least one layer of non-woven polymeric netting interposed between at least two layers of non-woven textile fiber batt layers which are fixed to said non-woven polymeric netting layer.

10. The papermaker's wet press felt of claim 9, wherein said textile fiber batt layers are fixed to said polymeric netting by needling.

11. The papermaker's wet press felt of claim 9, wherein said textile fiber batt layers are fixed to said polymeric netting by sewing and needling.

12. The papermaker's wet press felt of claim 9, wherein said textile fiber batt layers have a higher melt temperature than said polymeric netting whereby said fiber batt layers are fixed to said netting layer by heating.

13. The papermaker's wet press felt of claim 12, wherein said polymeric netting layer comprises a thermoplastic material selected from the group consisting of polypropylene, polyethylene, polyamide, and polyester.

14. The papermaker's wet press felt of claim 9, wherein said non-woven textile fiber batt layers include thermoplastic fibers dispersed therein.

15. The papermaker's wet press felt of claim 9 further including runner yarns fixed to a bottom surface thereof.

16. A non-woven, multilayer papermaker's wet press felt for use in a papermaking machine werein each and every layer is comprised entirely of a non-woven material said fabric comprising N layers of non-woven polymeric netting interposed between and alternating with Y layers of non-woven textile fiber batt material fixed to said non-woven polymeric netting wherein N and Y are positive whole numbers and Y is equal to or greater than N.

17. The papermaker's wet press felt of claim 16, wherein said textile fiber batt layers are fixed to said polymeric netting by needling.

18. The papermaker's wet press felt of claim 16, wherein said textile fiber batt layers are fixed to said polymeric netting by sewing and needling.

19. The papermaker's wet press felt of claim 16, wherein said textile fiber batt layers have a higher melt temperature than said polymeric netting whereby said fiber batt layers are fixed to said netting layers by heating.

20. The papermaker's wet press felt of claim 19, wherein said polymeric netting layers comprise a thermoplastic material selected from the group consisting of polypropylene, polyethylene, polyamide, and polyester.

21. The papermaker's wet press felt of claim 16, wherein said non-woven textile fiber batt layers include thermoplastic fibers dispersed therein.

22. The papermaker's wet press felt of claim 16, wherein a top and a bottom surface of said felt are defined by said batt layers.

23. The papermaker's wet press felt of claim 16 further including runner yarns fixed to a bottom surface thereof.

24. A multilayer papermaker's wet press felt wherein each layer is a non-woven material of either polymeric netting material or fibrous batt material, at least one layer being netting material and at least one layer being batt material, said layers being united in an integral structure.

25. A multilayer papermaker's wet press felt according to claim 24 wherein said layers alternate between non-woven polymeric netting layers and non-woven textile fiber batt layers.

26. A method of forming an integral, non-woven, papermaker's wet press felt for use in a papermaking machine which comprises the steps of:

(a) providing a plurality of non-woven polymeric netting layers;
(b) providing a plurality of non-woven textile fiber batt layers;
(c) interposing the plurality of non-woven polymeric netting layers in an alternating array with the plurality of non-woven textile fiber batt layers; and
(d) unifying said batt layers and said polymeric netting layers from step (c) to form an integral, multilayer felt wherein each and every layer of said felt comprises a non-woven material.

27. The method of claim 26, wherein said textile fiber batt layers are united to said polymeric netting layers by needling.

28. The method of claim 26, wherein said textile fiber batt layers are united to said polymeric netting layers by sewing and needling.

29. The method of claim 26, wherein said textile fiber batt layers have a higher melt temperature than said polymeric netting layers whereby said fiber batt layers are united to said polymeric netting layers by heating.

30. The method of claim 29, wherein said polymeric netting layers are a thermoplastic material selected from the group consisting of polypropylene, polyethylene, polyamide, and polyester.

31. The method of claim 29, wherein said non-woven textile fiber batt layers include thermoplastic fibers dispersed therein.

32. The method of claim 26, wherein the mesh count of said polymeric netting layers varies from layer to layer.

* * * * *

UNITED STATES PATENT AND TRADEMARK OFFICE

CERTIFICATE OF CORRECTION

PATENT NO. : 4,830,915

DATED : May 16, 1989

INVENTOR(S) : Michelle Diaz-Kotti

It is certified that error appears in the above-identified patent and that said Letters Patent is hereby corrected as shown below:

Column 1, lines 21 and 22, delete the word "paperamaking" and insert therefor --papermaking--.

Column 4, line 11, delete the word "parts" and insert therefor --part--.

Column 4, line 24, delete the number "0.90" and insert therefor --0.090--.

Claim 1, column 4, line 35, delete the word "alternating" and insert therefor --alternate--.

Claim 3, column 4, line 42, delete the word "papaermaker's" and insert therefor --papermaker's--.

Claim 4, column 4, line 45, delete the word "process" and insert therefor --press--.

Claim 16, column 5, line 24, delete the word "werein" and insert therefor --wherein--.

Signed and Sealed this

Twenty-eighth Day of November 1989

*Attest:*

JEFFREY M. SAMUELS

*Attesting Officer* *Acting Commissioner of Patents and Trademarks*